US010087706B2

(12) United States Patent
Roselier et al.

(10) Patent No.: US 10,087,706 B2
(45) Date of Patent: Oct. 2, 2018

(54) TUBULAR ELEMENT WITH INCLINED SEALING LIPS AND PROCESS FOR APPLYING IT TO THE WALL OF A WELL

(71) Applicant: Saltel Industries, Bruz (FR)

(72) Inventors: Samuel Roselier, Le Rheu (FR); Benjamin Saltel, Midland, TX (US); Romain Neveu, Rennes (FR); Jean-Louis Saltel, Le Rheu (FR)

(73) Assignee: Saltel Industries (FR)

( * ) Notice: Subject to any disclaimer, the term of this patent is extended or adjusted under 35 U.S.C. 154(b) by 456 days.

(21) Appl. No.: 14/432,621

(22) PCT Filed: Sep. 9, 2013

(86) PCT No.: PCT/EP2013/068612

§ 371 (c)(1),
(2) Date: Mar. 31, 2015

(87) PCT Pub. No.: WO2014/053283

PCT Pub. Date: Apr. 10, 2014

(65) Prior Publication Data

US 2015/0240589 A1 Aug. 27, 2015

Related U.S. Application Data

(60) Provisional application No. 61/710,071, filed on Oct. 5, 2012.

(30) Foreign Application Priority Data

Oct. 2, 2012 (FR) ..... 12 59311

(51) Int. Cl.

| | |
|---|---|
| ***E21B 33/128*** | (2006.01) |
| ***E21B 33/12*** | (2006.01) |
| ***E21B 43/10*** | (2006.01) |

(52) U.S. Cl.
CPC ..... *E21B 33/1285* (2013.01); *E21B 33/1208* (2013.01); *E21B 43/103* (2013.01)

(58) Field of Classification Search
CPC ..... E21B 33/1208; E21B 43/103
See application file for complete search history.

(56) References Cited

U.S. PATENT DOCUMENTS 4,809,776 A * 3/1989 Bradley ..... E21B 33/05 166/153
6,431,282 B1 * 8/2002 Bosma ..... E21B 33/14 166/207

(Continued)

FOREIGN PATENT DOCUMENTS

FR 2958966 A1 10/2011
WO 0061914 A1 10/2000

OTHER PUBLICATIONS

International Search Report for Application No. PCT/EP2013/068612 dated Oct. 16, 2013.

*Primary Examiner* — Giovanna Collins Wright
*Assistant Examiner* — Kristyn A Hall
(74) *Attorney, Agent, or Firm* — Lerner, David, Littenberg, Krumholz & Mentlik, LLP

(57) ABSTRACT

The present invention relates especially to a radially expandable tubular metallic element (2) which comprises on its external face (211) at least a series of annular sealing lips (5) made of elastically deformable material, these lips being spaced in pairs, the transversal cross section of each lip (5) having an end face (51) and two lateral walls (52, 53), characterized in that said lips (5) are in a non-metallic material and are inclined in the same direction, relative to said external face (211), that is, each of the lateral walls (52, 53) of each lip (5) forms a non-zero angle (α; β) relative to a radial plane (PR) of said element.

8 Claims, 6 Drawing Sheets

(56) References Cited

U.S. PATENT DOCUMENTS

| | | | | |
|---|---|---|---|---|
| 6,640,893 | B1 | 11/2003 | Rummel et al. | |
| 7,070,001 | B2 | 7/2006 | Whanger et al. | |
| 7,370,708 | B2 | 5/2008 | Simpson et al. | |
| 2005/0015963 | A1* | 1/2005 | Costa | E21B 17/042 29/523 |
| 2008/0230235 | A1* | 9/2008 | Loughlin | E21B 33/129 166/387 |

* cited by examiner

TUBULAR ELEMENT WITH INCLINED SEALING LIPS AND PROCESS FOR APPLYING IT TO THE WALL OF A WELL

CROSS REFERENCE TO RELATED APPLICATIONS

This application is a national phase entry under 35 U.S.C. § 371 of International Application No. PCT/EP2013/068612, filed Sep. 9, 2013, published in English, which claims the benefit of the filing date of French Patent Application No. 1259311 filed Oct. 2, 2012, and of U.S. Provisional Patent Application No. 61/710,071 filed Oct. 5, 2012, the disclosures of which are hereby incorporated herein by reference.

The present invention relates to a radially expandable tubular metallic element which is provided with a series of annular sealing lips.

It also relates to a process for tightly applying an element of this type against the well or well casing.

The technical field to which the present invention applies is that of the sealing of regions of a well relative to other regions, for example to delimit a sealed zone inside which it will be possible to operate later. By way of simple example, a hydraulic fracturing process could be carried out inside this zone.

To illustrate the prior art in this respect, the attached FIGS. 1 and 2 illustrate a fraction of tubular metallic conduit 1 which is placed inside a well, and more particularly in the horizontal part of the latter.

In practice, this conduit 1 also comprises a vertical upstream end which terminates in the surface of the well, as well as a curved intermediate portion for joining the vertical part to the horizontal part (the latter not shown here, for the sake of clarity).

It is a tubular conduit formed from several sections placed end to end so as to form a completion.

In the above two figures, the conduit is in place in a metallic tube (casing) A which has previously been placed inside the well, for example to reinforce its wall.

However, it can be that A designates the raw surface of the wall of the well in which it is proposed to work.

As is known per se, the conduit 1 comprises at least one opening 10 which make possible to have its internal space with the exterior.

The attached figures illustrate one opening 10 only. However, it is possible to use a larger number of openings, for example four or six.

Extending against the external face of this conduit and over part of the latter is a cylindrical or approximately cylindrical sleeve 2 whereof the opposite ends 20 are connected and fixed tightly to the external face of the conduit. This sleeve is preferably made of metal.

And still as is known, the sleeve 2 is covered over all or part of its length by a layer of elastically deformable material, for example elastomer, which constitutes an annular sealing "layer" 3 a few millimeters thick.

In FIG. 1 the sleeve 2 is illustrated in its initial state, specifically its wall is not yet deformed. At this stage, it is overall cylindrical. The representation of the figure, in which the central part is offset radially relative to the ends, is fictitious and illustrative only.

As is evident from FIG. 2, by application of sufficient fluid pressure P1 (preferably liquid such as water) inside the conduit 1, this pressure, via the openings 10 is communicated inside the sleeve 2 which expands radially beyond it elastic deformation limit.

In the process, the layer 3 of elastomer material returns to contact the internal wall of the casing A or of the well.

Next, by application of excess pressure ΔP, such that the overall pressure becomes P1+ΔP, the elastomer 3 compresses against the wall and consequently tightly insulates the annular spaces EA1 and EA2 which are arranged on either side of the sleeve 2.

When the cross is then lowered inside the conduit 1 to return to the initial pressure, the diameter of the sleeve 2 tends to decrease slightly, due to a small springback. This geometric modification must be compensated by the sealing layer 3 to preserve correct insulation between the abovementioned annular spaces.

In FIG. 2, Z references a zone which is illustrated on an enlarged scale in FIGS. 3 and 4.

The wall of the sleeve 2 bears reference numeral 21, and its respectively internal and external faces bear reference numerals 210 and 211.

With respect to the layer of material 3, its internal face is referenced 30, whereas its external face is referenced 31.

FIG. 3 shows the device during expansion of the sleeve, while FIG. 4 shows it after the expansion pressure has halted. Because the elastomer of the material 3 is relatively uncompressible, it compresses very little, even after application of strong excess pressure and contact with the wall of the well A.

This excess pressure can be of the order of 50 to 100 bars.

After withdrawal of the pressure and springback of the sleeve 2, it is possible for there to be no more contact between the internal wall of the well and the layer of material 3, creating a space j for communication between the abovementioned annular spaces EA1 and EA2.

These conditions do not produce satisfactory sealing.

It has also been proposed not to use a continuous layer of sealing material, but a series of annular sealing bands spread apart from one another, as described in document U.S. Pat. No. 6,640,893.

When the cross section (transversal section) of these sealing bands is considered, this means a succession of "slots" 3 which are separated from one another by annular spaces 4, as shown in FIG. 5.

Most of the time, the sleeve 2 is expanded while water fills the well such that this liquid is trapped between the sealing bands, in the spaces 4.

Since this liquid is not very compressible, the pressure ΔP is trapped between the bands 3 and the fluid can no longer escape.

For these reasons, the sealing defect highlighted in relation to FIGS. 3 and 4 exists here also.

Other expandable sleeve deformation techniques have also been proposed.

Document U.S. Pat. No. 7,370,708 discloses a device comprising metallic lips directly integral with the expandable sleeve.

During expansion of the sleeve, which is done with a mandrel sliding longitudinally, these lips are gradually deformed plastically against the wall. The minimal springback of these lips is not enough to compensate the plastical deformation and the decrease in diameter of the sleeve per se, which creates a communication space between the two annular spaces EA1 and EA2.

In addition, document U.S. Pat. No. 7,070,001 discloses sealing lips solid with an expandable sleeve which is deformed by a system of pulleys.

These lips are coupled to end layers of inflatable elastomer and serve also as anti-extrusion means.

The aim of the present invention is to rectify the problems described hereinabove in relation to the prior art and to provide a radially expandable tubular element whereof the annular sealing lips properly fulfil their function when are applied to the walls of a casing or a well.

So according to a first aspect of the invention the latter relates to a radially expandable tubular metallic element which comprises on its external face at least a series of annular sealing lips made of elastically deformable material, these lips being spaced in pairs, the transversal cross section of each lip having an end face and two lateral walls, characterised in that said lips are in a non-metallic material and are inclined in the same direction, relative to said external face, that is, each of the lateral walls of each lip forms a non-zero angle relative to a radial plane of said element.

According to advantageous and non-limiting characteristics taken singly or according to any combination:

said lateral walls are parallel;

said walls are non-parallel, their spread at the level of the end face being less than their spread at the level of their base;

said angle is between 20° and 70°;

said lips are fixed to said external face;

said lips are joined together at the level of their base by a bonding layer such that the lips and the layer form a monolithic whole;

it comprises at least one first series of lips inclined in a first direction and at least one second series of lips inclined in a second direction, opposite the first.

Another aspect of the invention relates to a process for tightly applying a radially expandable tubular element which comprises on its external face at least a series of annular sealing lips made of elastically deformable material, these lips being spaced in pairs, the transversal cross section of each lip having an end face and two lateral walls against the wall of a well or a casing in place in this well, this element having previously been positioned inside said well. This process is remarkable in that use is made of an element whose lips are in a non-metallic material and are inclined, in the same direction, relative to said external face, that is, each of the lateral walls of each lip forms a non-zero angle relative to a radial plane of said element and in that it comprises the following steps it comprises the following steps:

a) radial expansion under first pressure P1 of said element until the lips come into simultaneous or quasi-simultaneous contact with said wall;

b) application, over a predetermined period, of second pressure P2 greater than the first to compel the lips to be pushed firmly against the wall;

c) relaxing of said pressure.

According to preferential but non limitative features:

radial expansion by hydroforming or by means of an inflatable tool is carried out;

use is made of an element whose walls are parallel;

use is made of an element whose lateral walls are non-parallel, their spread at the level of the end face being less than their spread at the level of their base;

use is made of an element whose angle is between 20° and 70';

use is made of an element whose lips are fixed to said external face;

use is made of an element whose lips are joined together at the level of their base by a bonding layer, such that the lips and the layer form a monolithic whole.

use is made of an element which comprises at least one first series of lips inclined in a first direction and at least one second series of lips inclined in a second direction, opposite the first.

Radial expansion is preferably done by hydroforming or by means of an inflatable element (in English «inflatable element» or «inflatable packer»).

Other characteristics and advantages of the present invention will emerge from the detailed description of some preferred embodiments.

BRIEF DESCRIPTION OF THE DRAWINGS

This description will be given in reference to the attached diagrams, in which.

Figure 13:
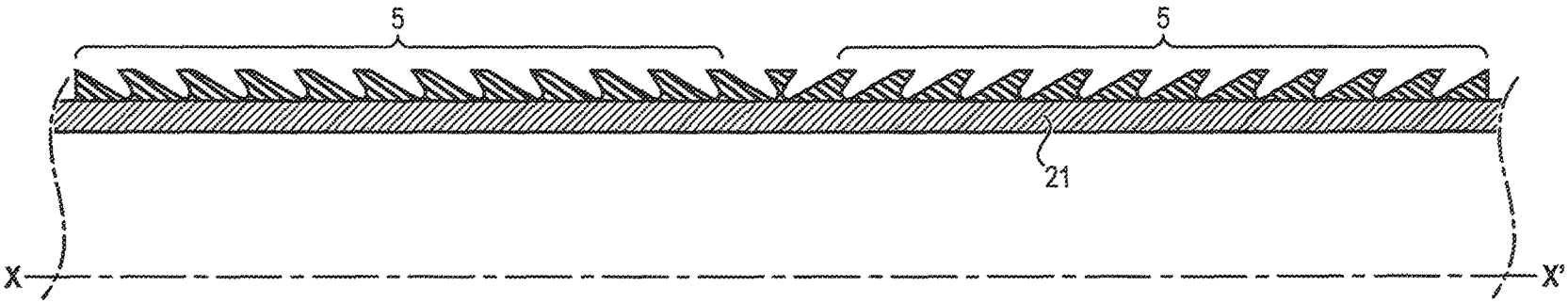
Figure 14:
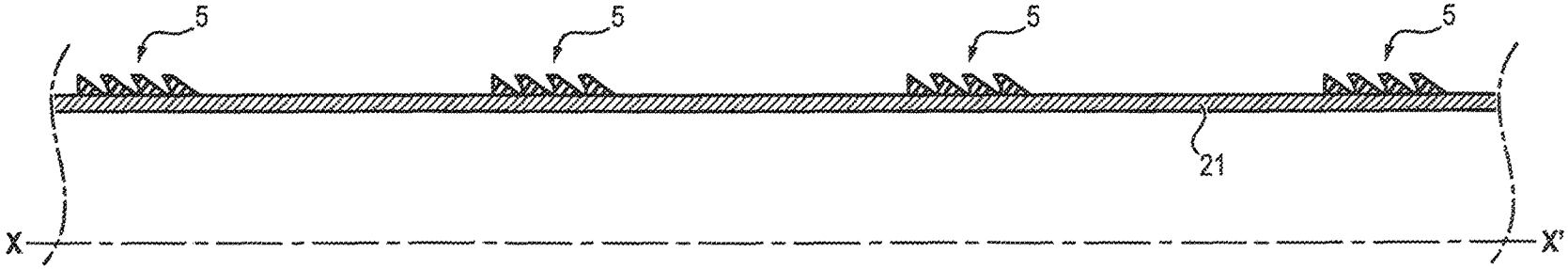

finally, FIGS. 13 and 14 schematically illustrate different possible implantations of the sealing lips on the tubular element.

Figure 1:
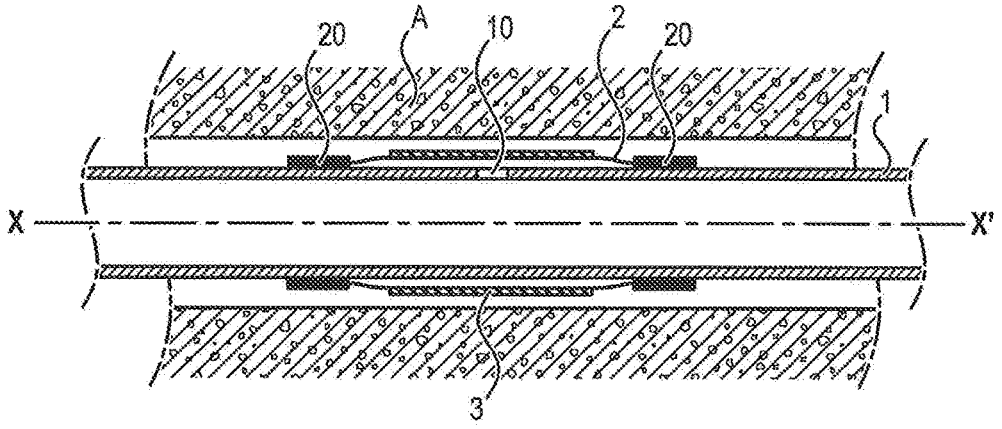
FIG. 1 PRIOR ART
FIGS. 1 and 2 illustrate a fraction of a tubular metallic conduit placed inside a wall and a cylindrical sleeve extending against an external face and over a part of the conduit, according to prior art.
Figure 2:
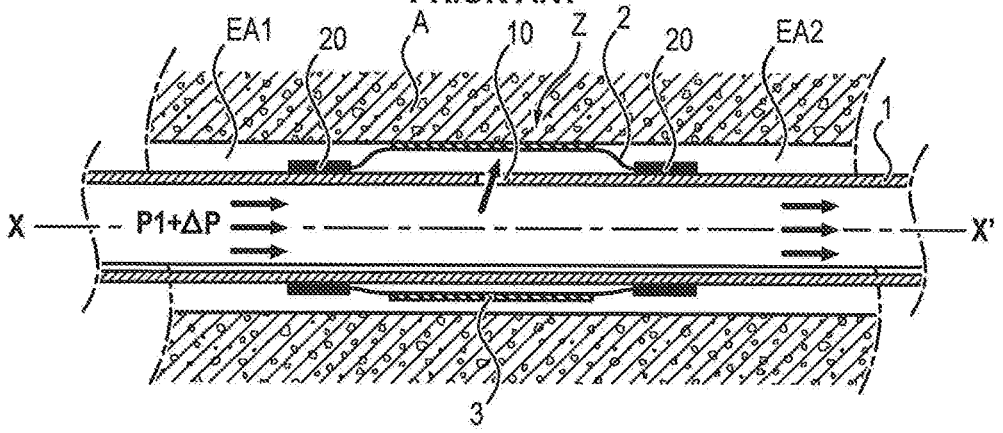
FIG. 2 PRIOR ART
Figure 3:
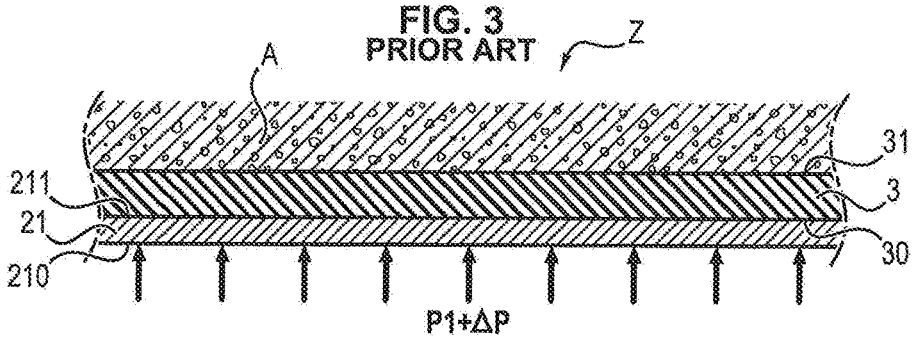
FIG. 3 PRIOR ART
FIG. 3 illustrates an expanded state of the sleeve of FIGS. 1 and 2 under application of an external pressure, according to prior art.
Figure 4:
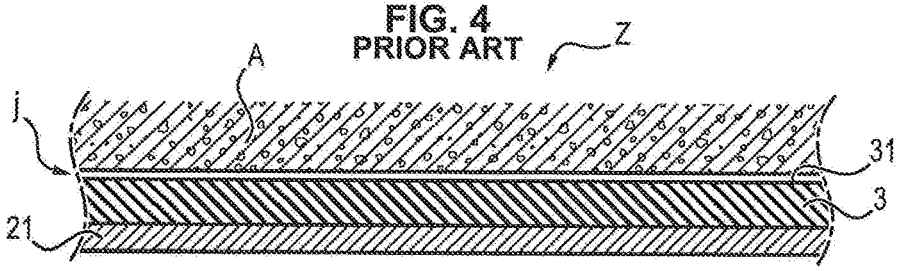
FIG. 4 PRIOR ART
FIG. 4 illustrates the state of the sleeve of FIG. 3 after withdrawal of the pressure, according to prior art.
Figure 5:
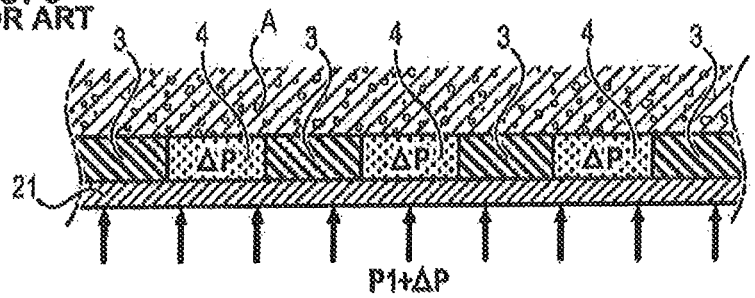
FIG. 5 PRIOR ART
FIG. 5 illustrates partial cross-section of a series of sealing bands resulting in a succession of slots, according to prior art.
Figure 6:
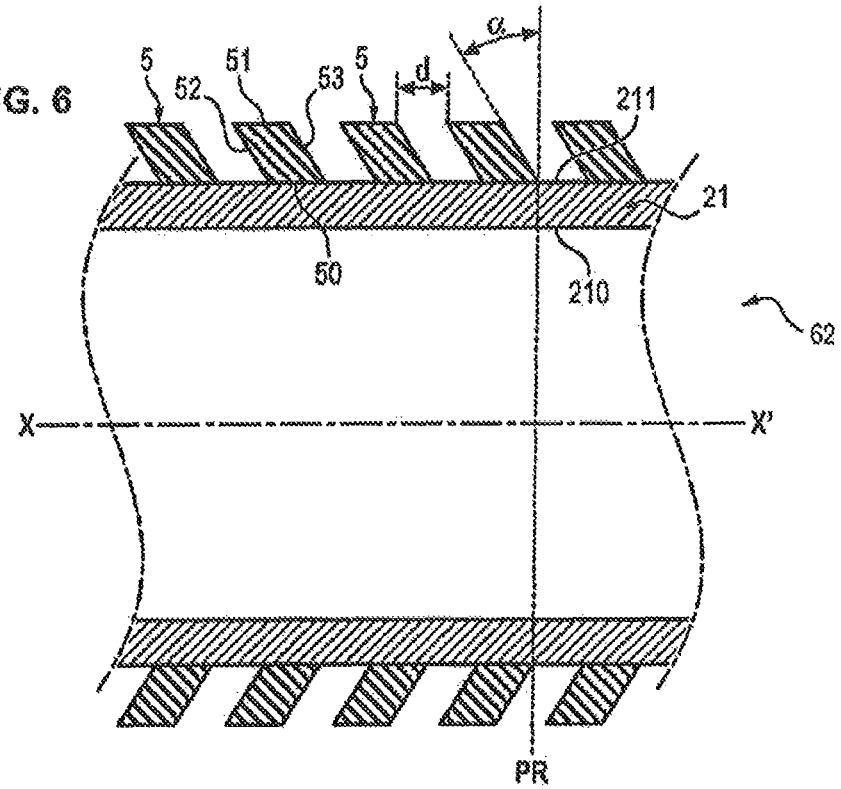
FIG. 6 is a partial view in section along a plane of vertical and longitudinal section of a tubular element according to the invention.

In reference to FIG. 6 and as known per se, the tubular element, represented here partially and referenced 62, comprises on its external face 211 a series of annular sealing lips 5 of elastically deformable material such as synthetic rubber.

These lips are for example fixed to the external face 211 of the element 62 by adhesion or any other means known to the expert.

Here, five lips only have been illustrated. This is however a possible exemplary embodiment and it is evident that a much higher number of sealing lips can be used.

According to the straight (cross) section illustrated here (that is, according to a plane of transversal section), these lips, which are spaced in pairs by a distance of value d substantially equal to their width, have a free end face 51 and two lateral walls 52 and 53. Their lower face (or base) is referenced 50.

According to an essential characteristic of the invention, these lips are inclined relative to the external face 211 of the element 62, that is, the abovementioned lateral walls 52 and 53 are oriented in the same direction, and each of them forms a non-zero angle relative to a radial plane PR of the element 62.

In this case, in the embodiment represented here, the lateral faces 52 and 53 are parallel to one another and each forms the same angle α relative to the associated radial plane PR.

The expression "radial plane" means a plane which perpendicularly cuts the longitudinal axis X-X' of the element 62.

To the extent where the element according to the invention is tubular, the following figures present "semi-views" in which only the upper part of its wall appears, for the sake of clarity.

Figure 7:
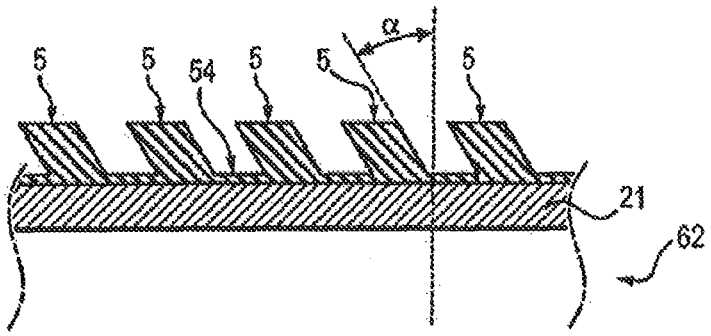
FIG. 7 is also a view in section of a variant embodiment of FIG. 6, limited to the upper part of the wall.

FIG. 7 shows an embodiment very similar to the preceding one. It differs therefrom however by the fact that the lips 5 are all attached to a layer of elastomer material 54 fixed on the element 62 such that all the lips are kept together by this layer 54 to form a monolithic whole.

Figure 12:
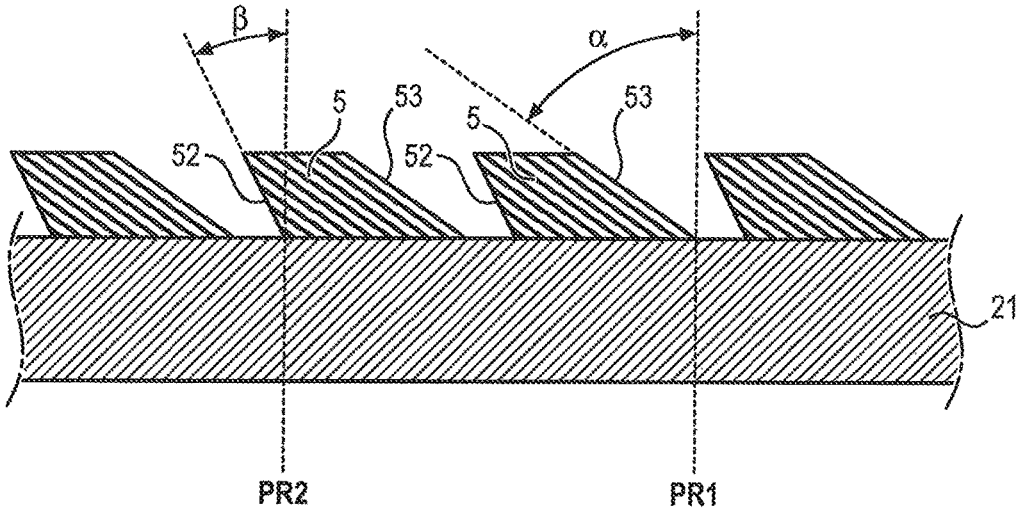
FIG. 12 is an enlarged view of another embodiment of the sealing lips.

In the embodiment of FIG. 12, substantially the same structure is used, if only the lateral faces 52 and 53 are inclined according to a different angle value.

In this case, the face 53 is inclined relative to the associated radial plane PR1 by an angle α greater than that forming the second lateral wall 52 relative to another associated radial plane PR2.

In fact, it is noted effectively visually that the corresponding angle β is less than α.

In any case, in this embodiment in which said angle is not the same for each of the faces, the spread of the walls at the level of the end face 51 of each lip is less than their spread at the level of their base 50. This contributes to imparting greater stability to the lips.

In other words, this means that the lips, when viewed here in transversal section, taper as the distance from their base 50 increases.

The embodiment of FIG. 13 deals with two sets of lips 5, a first set, located to the left of the figure, in which all the lips are oriented in a first direction, and a second set of lips 5, located to the right of the figure, whereof each element is oriented according to a direction opposite the abovementioned first direction.

The interest in such an arrangement will be understood later in the description.

Finally, FIG. 14 illustrates an element 62 which is provided from four different areas in which a set of lips 5 is provided.

Reference will now be made to FIGS. 8 to 11 to explain the advantages associated with the characteristics of the invention and detail the phenomena involved.

For this to happen, in a first instance reference will be made to FIGS. 8 and 9 which illustrate a single sealing lip 5 for the sake of clarity.

Of course, what will be described hereinbelow for this lip applies also for adjacent lips.

Due to its particular inclination, this lip has a function which can be qualified as "asymmetrical", meaning that it retains pressure better in one direction than in the opposite direction.

So the pressure retained from one side of the lip is greater than the pressure retained from the other.

Figure 8:
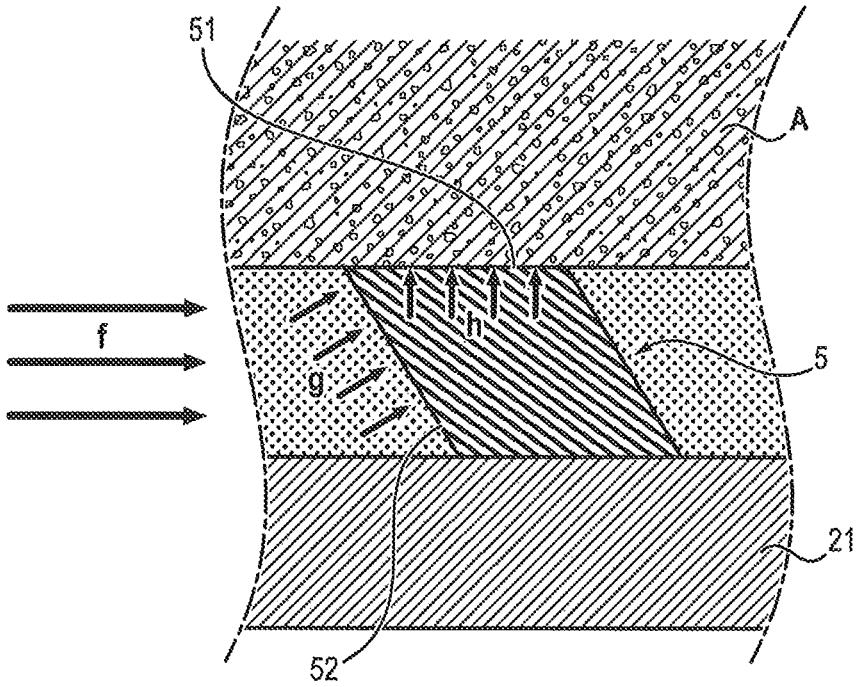
FIGS. 8 and 9 are highly schematic views showing the phenomena involved at the level of a sealing lip of the element, as a function of the pressure applied.

More precisely, with respect to FIG. 8 and the pressure applied to the wall 52 of the lip, it is evident, as shown by arrows f, g and h, that the initially axially directed pressure encounters the inclined slope of the wall 52 which thrusts the material of the lip upwards, as shown by arrows h, contributing to press the end face 51 against the wall of the well A.

Opposite, that is, to the side of the face 53, the pressure materialised by arrows k and 1 is exerted against the face 51 in the direction of its subsidence such that the lip tends to move away slightly from the wall of the well A, so as to form a passage 6 via which the liquid is engulfed, as shown by the arrow m.

It is these two phenomena which, due to the process according to the present invention, produce perfect sealing.

The first step a) of the process consists of radially expanding the element 62 under first pressure P1 until the lips 5 come into contact with the wall of the well A or the casing already positioned in this well.

Figure 10A:
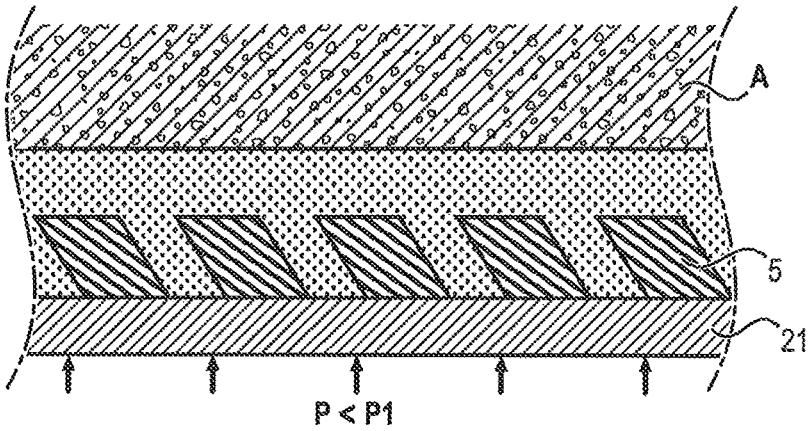
FIGS. 10A to 10D are diagrams which illustrate the different steps of the process according to the invention.
Figure 10B:
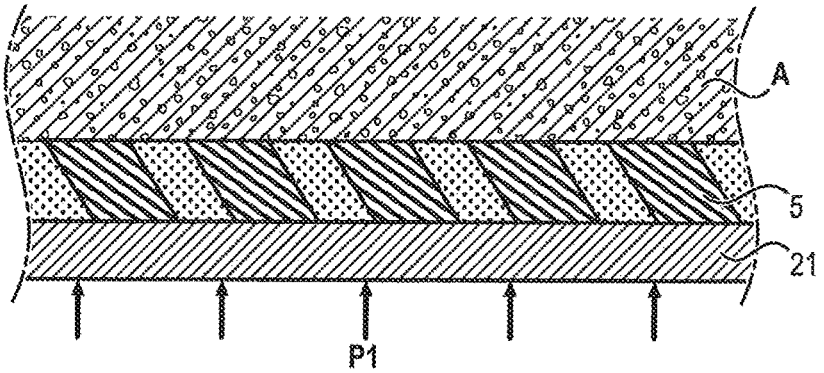

This is shown schematically in FIGS. 10A and 10B.

The following step consists of applying, over a predetermined period, for example of the order of 2 to 5 minutes, a second pressure P2 greater than the first. In other words, this pressure P2 is equal to P1+ΔP, as indicated in FIGS. 10C and 11.

In the process, this excess pressure is applied to the liquid (or more generally to the fluid) which is trapped in between the lips 5. Evacuation of the liquid is possible via the "first" lip, that is, the lip which both undergoes the excess pressure ΔP and also the pressure P0 initially prevalent in the well.

Figure 10C:
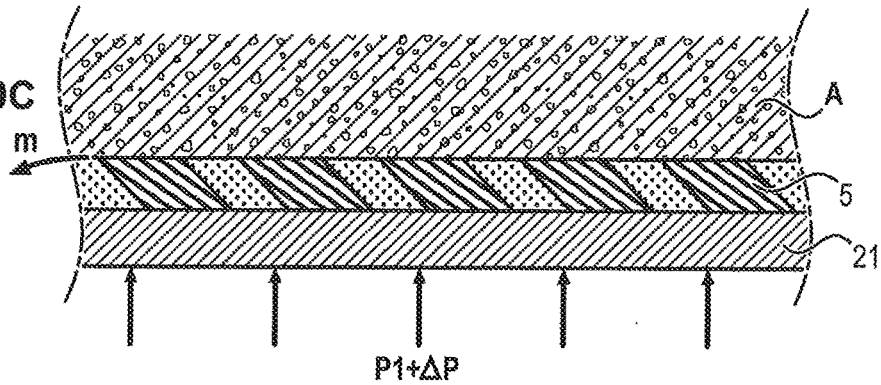
Figure 10D:
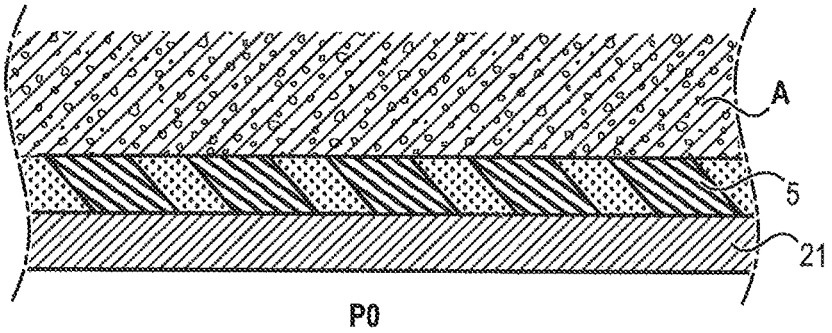
Figure 11:
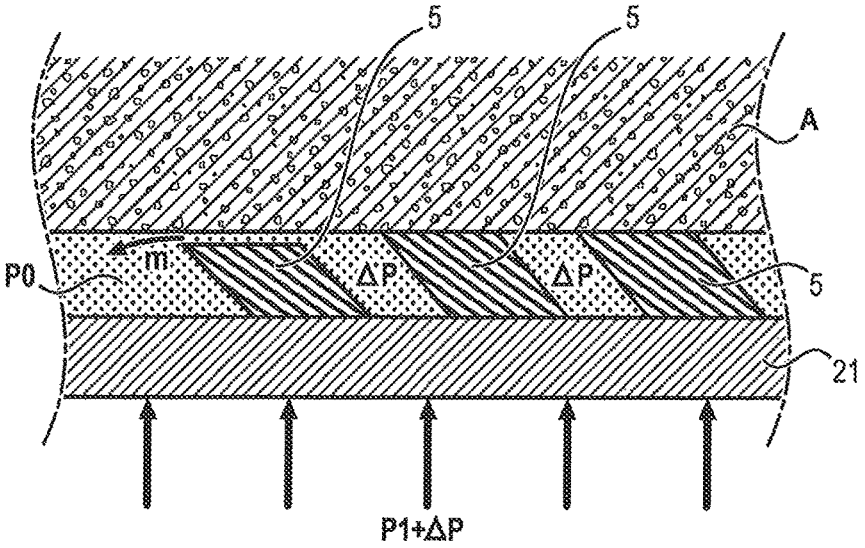
FIG. 11 is an enlarged view of the step corresponding to FIG. 10C.

As shown in FIGS. 10C and 11, this is the lip located to the left of the figures, that is, the one placed more upstream relative to the adjacent lips.

Figure 9:
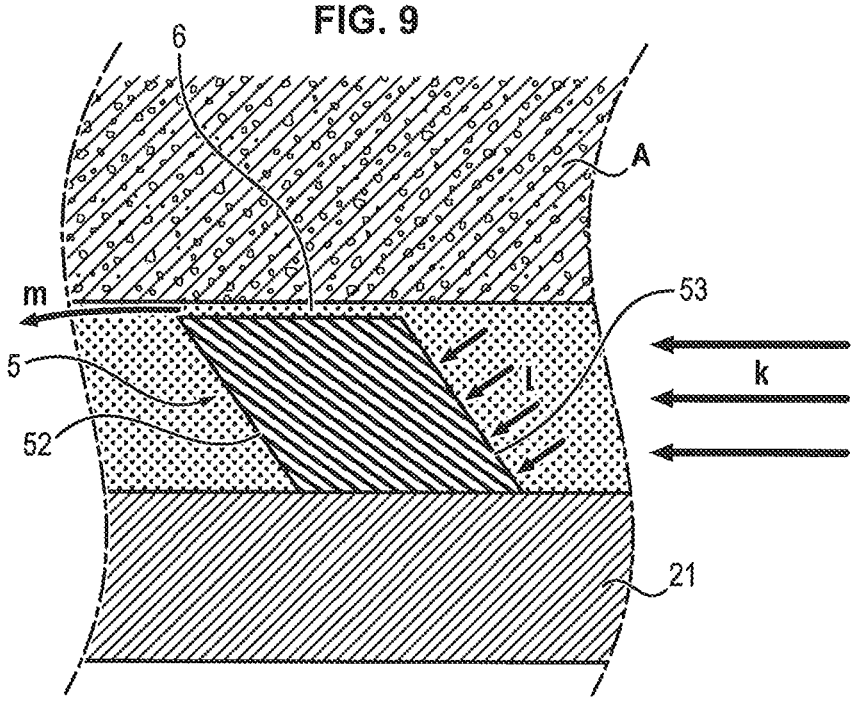

Evacuation of the liquid is possible via this first lip, according to the phenomenon explained in relation to the description of FIG. 9.

This contributes to "emptying" the space located between this first lip and the following.

All the liquid trapped between the lips is gradually evacuated and the rubber is sufficiently compressed to compensate the springback of the deformable element 62.

This ensures perfect sealing at the level of all the lips 5. This phenomenon is of course also used in the event of lips such as those illustrated in FIG. 12.

In this configuration, where the angle α is greater than β, it is guaranteed that the general shape of the lips is modified only slightly during radial expansion of the expandable element 62. In fact, a lip of minimal thickness with identical angles will rather tend to fold back to the outer surface of the conduit during expansion. Here, because the width (thickness) of their base is greater than their width at the level of their free end, this fold-back phenomenon is not (or rarely) found.

In the case of an arrangement of lips such as that illustrated in FIG. 13, considerable pressure in two opposite directions is retained, but evacuation of the liquid during application of excess pressure is still possible.

This configuration is also particularly advantageous since the resulting liquid vacuum causes a suction effect and keeps the expandable element 62 placed against the wall of the well after return to lower pressure P1. The lip located in the middle is not obligatory and has no real function.

The arrangement of lips such as shown in FIG. 14 diminishes the value of the excess pressure ΔP necessary for compression of the lips. The excess pressure ΔP applied inside the entire sleeve is in fact applied to a reduced number of lips, effectively boosting excess pressure applied locally.

The invention claimed is:

1. A process for tightly applying a radially expandable tubular element against a wall of a well or a casing in place in said well in which said tubular element comprises on an external face thereof at least a first series of annular sealing lips made of elastically deformable material, each of the lips being spaced apart from an adjacent lip, the transversal cross section of each lip having an end face and two lateral walls, the element having previously been positioned inside said well or casing, wherein the lips made of a non-metallic material and are inclined, in a same first direction, relative to said external face, that is, each of the lateral walls of each lip forms a non-zero angle (α; β) relative to a radial plane (PR, PR1, PR2) of said tubular element, said lips being joined together at the level of their base by a bonding layer, such that the lips and the layer form a monolithic whole, the method comprises:

a) radial expansion under a first pressure (P1) of said element until the lips come into contact with said wall or the casing;

b) application, over a predetermined period of a second pressure (P2) greater than the first pressure to compel the lips to be pushed firmly against the wall;

c) relaxing of said second pressure.

2. The process as claimed in claim 1, wherein in step a) radial expansion by hydroforming is carried out.

3. The process as claimed in claim 2, wherein each of the lateral walls of each lip forms an angle (α, β) between 20° and 70°, relative to the radial plane of said tubular element.

4. The process as claimed in claim 2, wherein the lips are fixed to said external face.

5. The process as claimed in claim 2, wherein the tubular element further comprises at least one second series of lips inclined in a same second direction, said second direction being opposite to said first direction.

6. The process as claimed in claim 1, wherein the lateral walls are parallel.

7. The process as claimed in claim 1, wherein the lateral walls are non-parallel, their spread at the level of the end face being less than their spread at the level of their base.

8. The process as claimed in claim 1, wherein the said element is radially expanded until the end faces of the lips come into contact with said wall or the casing; and wherein the second pressure (P2) is applied compelling the end faces of the lips to be pushed firmly against the wall or the casing.

* * * * *